United States Patent [19]

Longbrake

[11] Patent Number: 4,486,982

[45] Date of Patent: Dec. 11, 1984

[54] FOLDABLE HOLDING DEVICE

[76] Inventor: Howard R. Longbrake, 16740 Indian Hollow Rd., Grafton, Ohio 44044

[21] Appl. No.: 451,446

[22] Filed: Feb. 15, 1983

[51] Int. Cl.[3] ..... B24B 3/54

[52] U.S. Cl. ..... 51/68; 51/221 R; 76/82; 269/3

[58] Field of Search ..... 51/221 R, 221 BS, 69, 51/68; 269/3; 76/82

[56] References Cited

U.S. PATENT DOCUMENTS

| | | | |
|---|---|---|---|
| 1,148,303 | 7/1915 | Farrar | 51/69 |
| 1,386,757 | 8/1921 | Bergman | 51/221 R |
| 1,951,554 | 3/1934 | Martin | 51/221 R |
| 2,370,908 | 6/1945 | Llorens | 51/221 R |
| 3,819,170 | 6/1974 | Longbrake | 269/3 |
| 4,320,892 | 3/1982 | Longbrake | 51/69 |

FOREIGN PATENT DOCUMENTS

| | | | |
|---|---|---|---|
| 10760 | of 1927 | Australia | 51/221 |

*Primary Examiner*—Harold D. Whitehead
*Attorney, Agent, or Firm*—Gustalo Nunez; Clyde Haynes

[57] ABSTRACT

The improvement in a blade honing device having jaw members adapted to grip a blade to be honed and having honed guide members is to pivotally secure the hone guide members to one of the jaw members in such manner that the hone guide members may be folded from an operative position to a folded position in which they lie contiguous to and lengthwise along the jaw members.

1 Claim, 7 Drawing Figures

FOLDABLE HOLDING DEVICE

BACKGROUND OF THE INVENTION

1. Field of the Invention

The field of the invention is in portable holding devices adapted to grip and hold blades having edges to be honed and provided with guides for guiding the honing tool relative to the edge being honed.

2. Description of the Prior Art

The nearest prior art known to the inventor are his own patents identified as follows. U.S. Pat. No. 3,819,170, Portable Sharpener, issued June 25, 1974, discloses a portable knife sharpener having jaws adapted to grip a blade and having guide members adapted to guide a honing tool or relative to and in engagement with the edge of the blade being sharpened. In this device the guide members are fastened to the end of one of the jaws opposite the gripping end of the jaws.

In the U.S. Pat. No. 4,320,892 Knife Sharpener issued Mar. 23, 1982 to the inventor there is also disclosed a set of blade gripping jaws with guide members secured to the top and bottom surfaces to guide the hone area. There is no provision or capability of folding the guide members into a position in which they are contiguous to and extend lengthwise of the jaws in either of these prior art references.

SUMMARY OF THE INVENTION

The present invention provides a portable honing device for guiding the hone relative to an edge being sharpened in such manner that the edge may be very accurately sharpened the same or identically on both sides of the blade and also in which the guide members for the hone may be folded contiguous to and along side the jaw members supporting the blade when the honing device is not in use.

The object of the invention is to improve honing devices by having the guide members foldable contiguous to the jaw members when the device is not in use and by having the honing guide members pivotable to an operative position to accurately guide the hone when the device is in use.

It is apparent that the honing device must be rugged and yet be sufficiently precise to assure an almost perfect and very sharp edge on a blade being honed. A portable device must also be light in weight and compact so that it may be carried in a pocket or a tool box without becoming damaged, bent or otherwise disarranged in transporting it from place to place such for example a hunter carrying it in the woods or a military man carrying it during combat. The hone guide members thus must accurately hold the hone in preselected position relative to the edge being honed while they are in the operative position and yet be protected from bending or other destructive forces when they are in use. Thus the present invention has as it's main object the preservation of the accuracy of the honing device by providing a design whereby the hone guide members may be folded against and along side the jaws during transporting or non-use or storage of the device. These objects and other advantages and objects of the invention will become more apparent from a fuller understanding of the invention, the preferred embodiment of which is described and illustrated herein and set forth in the attached claims.

DESCRIPTION OF THE PREFERRED EMBODIMENT

Figure 1:
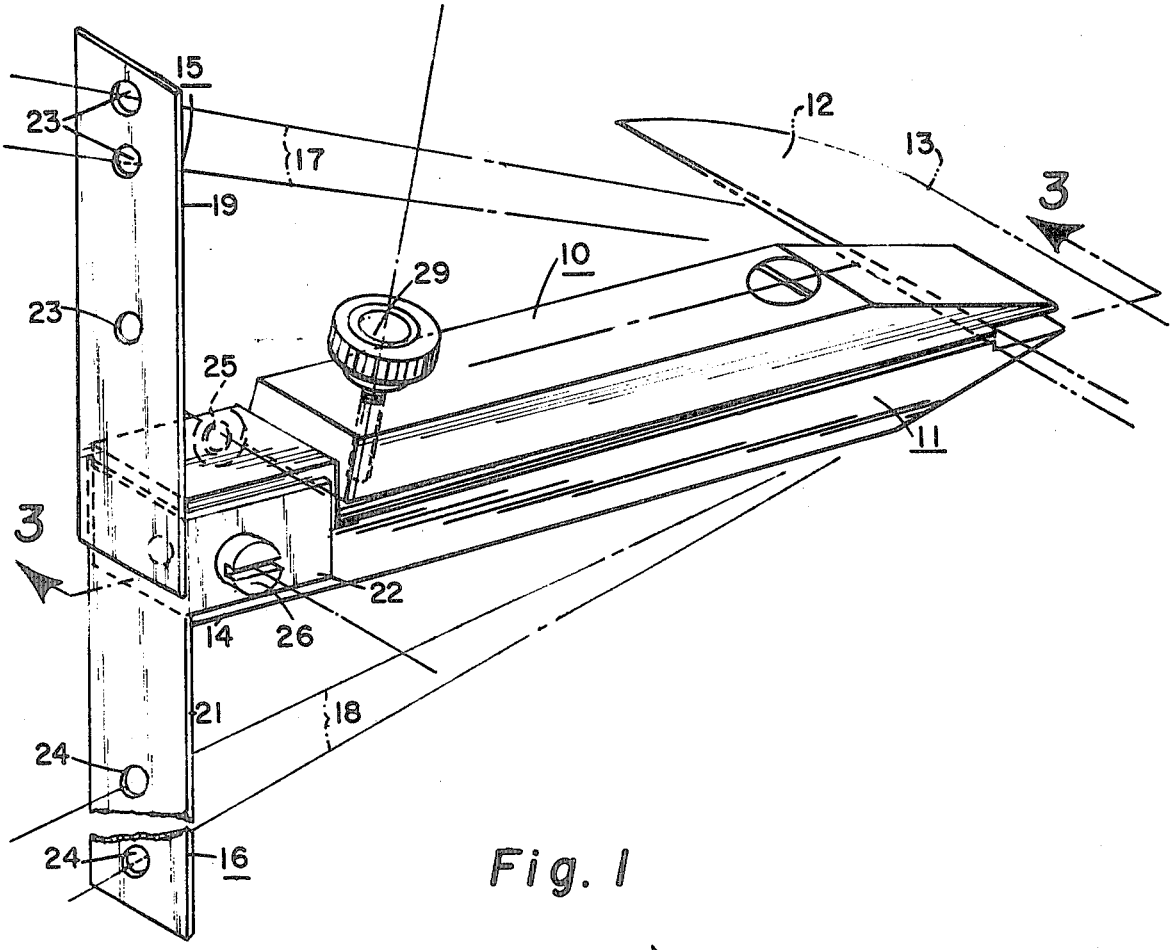
FIG. 1 is a perspective view of the honing device showing the jaw members in operative position.

In FIG. 1 there is illustrated preferred embodiment of the invention showing improvement of having the guide members foldable from the operative position illustrated in FIG. 1 to the folded position as the honing device is used with the hone as fully described in the herein referred to prior U.S. Pat. Nos. 3,819,170, Portable Sharpener, issued June 25, 1974 and 4,320,892, Knife Sharpener, issued Mar. 23, 1982 respectively. In this blade honing device there are elongated jaw members 10 and 11 adapted to grip a blade 12 having an edge 13 to be honed. The jaw members are elongated and the blade is held in such position that the edge to be honed is disposed generally transverse to the length of the jaw members 10 and 11. In this instance the jaw member 11 has secured to its remote end 14 from the end which grips blade 12 to honed guide members 15 and 16. In FIG. 1 the guide member 15 is shown in its operative position extending outwardly from the jaw members is to guide a hone (not shown) in a selected path 17 lengthwise of the jaw members and in engagement with and transverse to the edge of the blade 12 being honed. Also, the hone guide member 16 is illustrated in FIG. 1 as extending outwardly from the jaw 11 to guide a hone (not shown) in a selected path 18 generally lengthwise of the jawmembers and in engagement with and transverse to the edge 13 of the blade 12 being honed.

Figure 2:
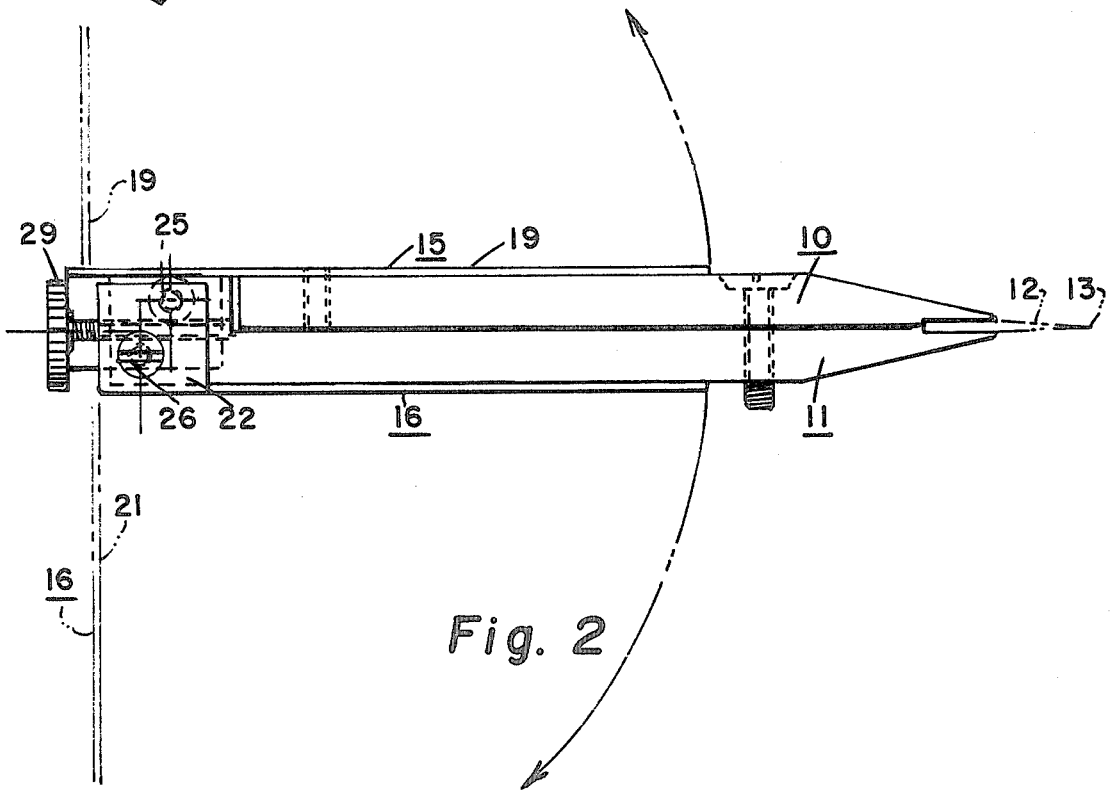
FIG. 2 is a side elevational view of the honing device showing the hone guide members folded along side and continguous to the jaw members.

The improvement comprises the guide members 15 and 16 being pivotally movable relative to the jaw members 10 and 11 between an operative position as illustrated in FIG. 1 and a folded position as in FIG. 2, so that the device might easily be carried in a pocket or a relatively small space by hunters, fishermen, military personnel and also to prevent bending or catching of the guide members 15 and 16 to render them misaligned while the hone device is not in use.

Figure 3:
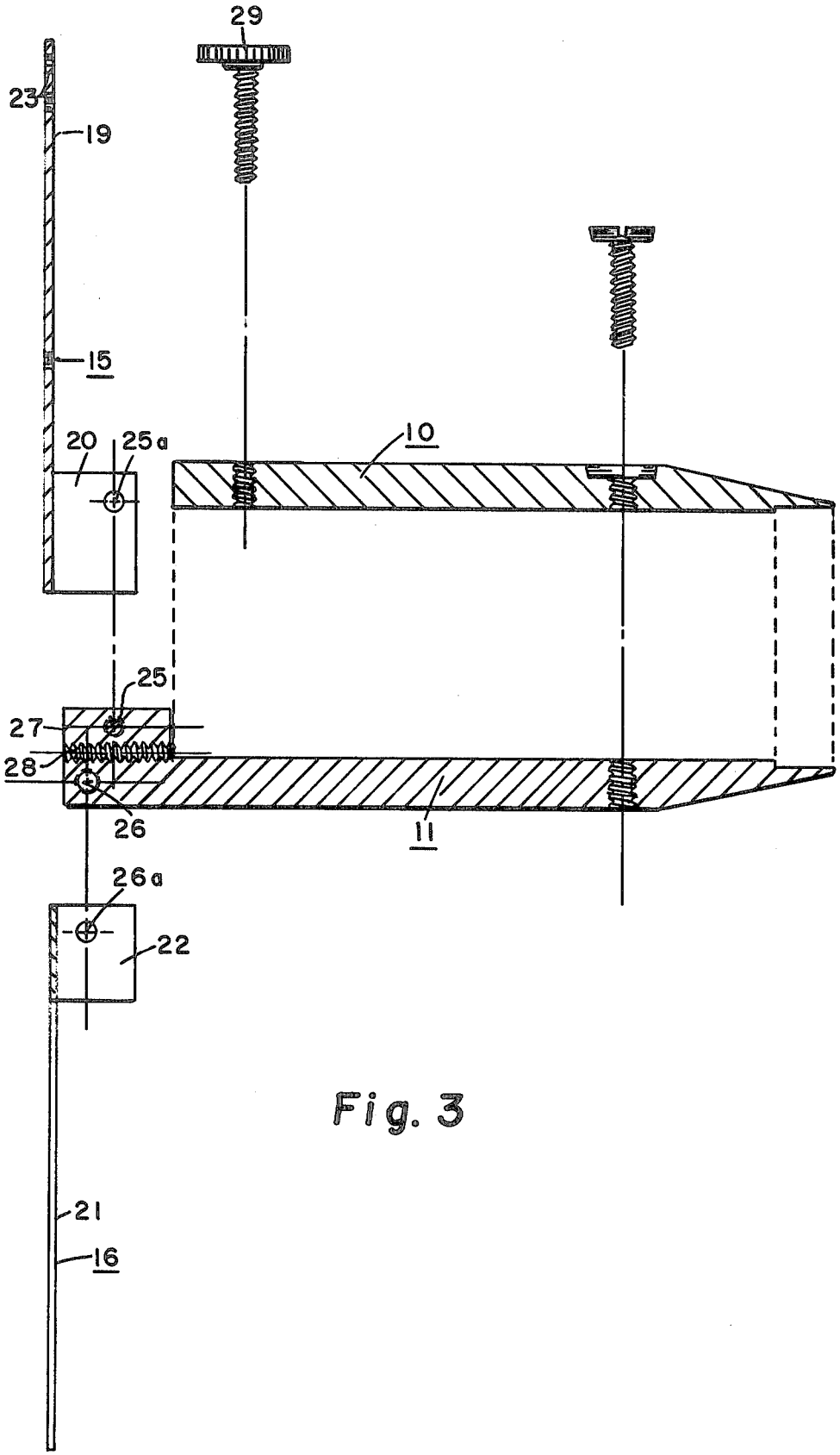
FIG. 3 is an exploded view along the sectional line 3—3 of FIG. 1 to better illustrate the details of the respective parts.

In the preferred embodiment and as more thoroughly illustrated in FIG. 3, the guide member 15 is provided with a hone guide portion 19 and a mounting wing portion 20 while guide member 16 is provided with a hone guide portion 21 and a wing portion 22. The hone guide portion 19 is provided with hone receiving openings 23 and the hone guide portion 21 is provided with hone receiving openings 24 which are selectively spaced equadistant from an axis or plane extending lengthwise through the jaw members 10 and 11, the blade 12 and the edge 13 being honed. For purposes as described in the aforementioned prior art patents, the mounting wing portions 20 and 22 extend at right angles to and from their respective hone guide portions 19 and 21 and are at one end of the hone guide portions respectively.

The guide members 15 and 16 are physically mounted on the remote end 14 of jaw member 11 by having wing portions 20 and 22 respectively fastened by a fastening means such for example, screws 25 and 26. The screw 25 pivotally fastens wing portion 20 to one side of the remote end 14 of jaw member 11 and the screw 26 pivotally fastens the mounting wing portion 22 to the opposite side of the remote end 14 of the jaw member 11 as illustrated in the drawings. The screws 25 and 26 provide respective separate pivot axis perpendicular and horizontally through the length of the jaw members and on the remote end from the blade 12 and about which the guide members 15 and 16 pivot between their outwardtive position of FIG. 1 and their folded position of FIG. 2. The screw 25 extends through a hole **25*a* in mounting wing portion 20 and the screw 26 extends through a hole 26*a* in the mounting wing portion 22. The axis of the holes 25*a* and 26*a* and the screws 25 and 26 are spaced from the terminal remote end sufface 27 respective distances such that the different axes are separated from each other a distance greater than one-half the thickness of guide portions. It is understood that the positions of the holes 25*a* and 26*a* and the positions of the pivot axes provided by the screws 25 and 26 may be changed from the preferred embodiment illustrated so long as and when in the operative position, as illustrated in FIG. 1 the ends of the guide portions at the wing portions overlap each other at the remote end of the jaw member. The positions of the holes 25*a* and 26*a* are also preselected in accordance with the positions of the hone receiving openings 23 and 24 so that the hone receiving openings 23 and 24 are properly spaced equadistant from the plane of the blade 12 to insure honing both sides of the edge 13 identical to each other. For convenience the remote end has also been provided with a screw hole 28 to receive the screw 29 so that it may be removed from the jaw member 10 when the hone guide members are in folded position as illustrated in FIG. 2**.

When the hone guide members 15 and 16 are in folded position as illustrated in FIG. 2, each guide member lies contiguous to and lengthwise along at least one of the jaw members 10 and 11. To move the hone guide members to their operative position of FIG. 1, it is simply necessary to remove the thumbscrew 29 from the remote end, pivot the jaw members to their operative position and insert the thumb-screw 29 in the top jaw 10 as illustrated in FIG. 1. Thereafter blade 12 is inserted between the jaw members 10 and 11 the thumbscrew 29 screwed into jaw member 10 to grip the blade 12 between the jaw members 10 and 11. A hone is inserted through the preselected one of the hone receiving openings 23 and 24 and placed in honing engagement with the edge 13 of the blade 12. It is thus apparent from the description of the preferred embodiment that a very precise honing of an edge of a blade maybe had when the honing guide members are in operative position and that the device may be protected from damage while it is carried in the wilderness or tool boxes and the like by folding the guide members down to their folded position while it is not in use. It is further evident that the exact location of the pivot axes may be preselected or varied by changing the location of the pivot screws and their holes in the wings pivotally mounting respective guide members to the sides of the jaw members.

Figure 4:
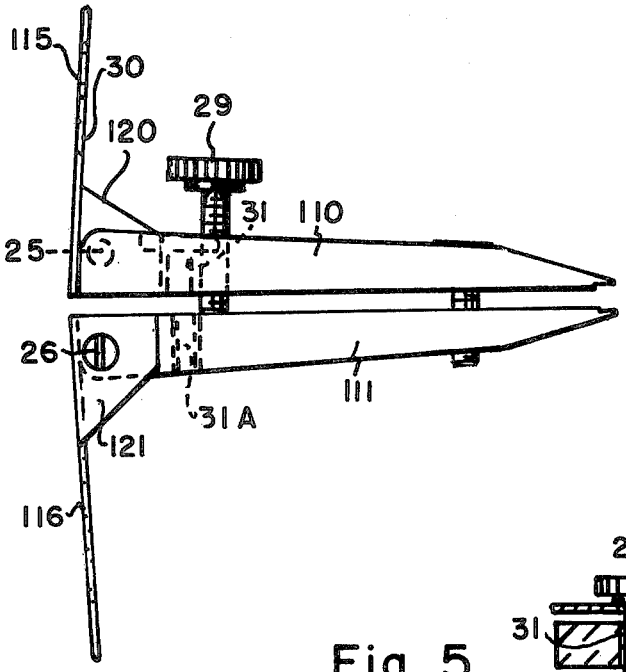
FIG. 4 is a view of a modification of the honing device in operative position.
Figure 5:
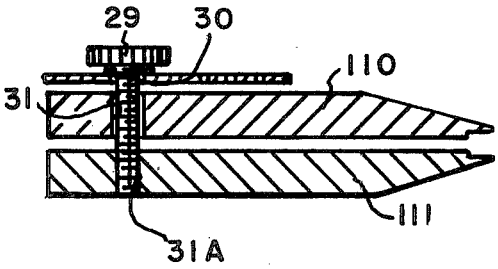
FIG. 5 is a view of the device of FIG. 4 in folded position, with part thereof in cross section.

In the modification illustrated in FIG. 4 the elongated jaw members 110 and 111 are quite similar and substantially identical to each other. The guide member 115 has its wing portion 120 pivotally mounting by screw 25 to jaw member 110. Similarly guide member 116 has its wing portion 121 pivotally mounted by screw 26 to guide member 116. When the guide members 115 and 116 are in their operative position they may lie in the same plane and each abuts or overlies its respective end of its respective jaw member. When the guide members are in their folded position as illustrated in FIG. 5 the thumb-screw 29 may be inserted through a suitable opening 30 and guide member 115 and into suitable aligned openings 31 and **31*a* in the jaw members 110 and 111**.

The blade honing device illustrated and thus described in connection with FIGS. 4 and 5 may be used in substantially the same manner and for the same purposes to hone the edge of a blade as the preferred embodiment of the invention.

Figure 6:
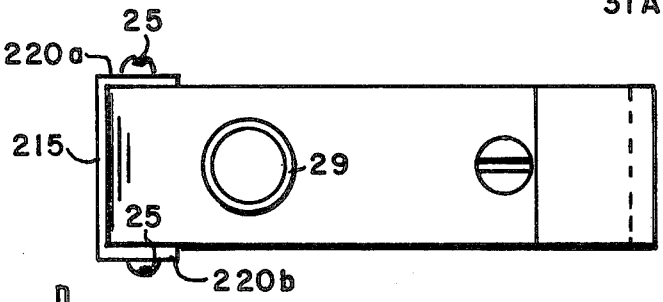
FIGS. 6 and 7 are views of other modifications of the device.

In the illustration in FIG. 6 the guide member 215 is provided with two wing portions **220*a* and 220*b*. One of these wing portions 220*a* would thus be on one side of the jaw member and the other wing portion 220*b* would be on the opposite side of the jaw member with the screws 25** being on a common axis to provide for pivotal movement of the jaw member between operative position and folded position.

Figure 7:
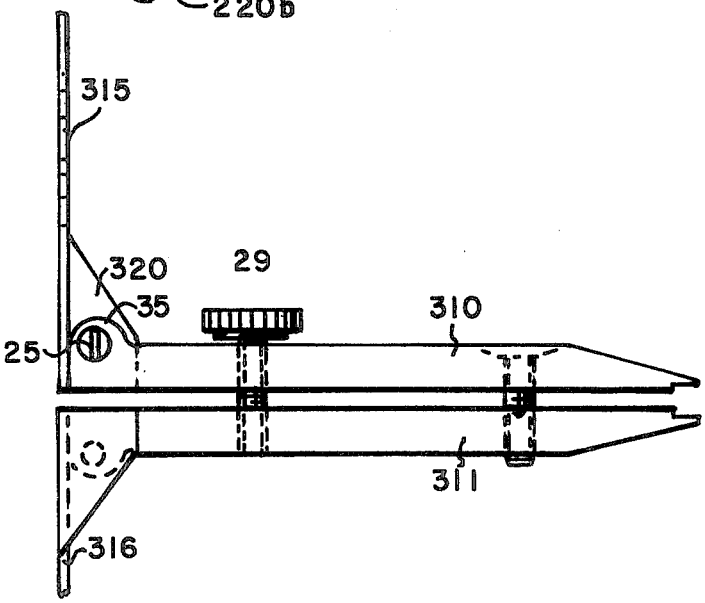

In the modification of FIG. 7 each of the jaw members as illustrated as having a raised portion such for example, raised portion 35 on jaw member 310. This raised portion 35 is at the remote end 314 and pivotally supports the wing portion 320 of the guide member. In this instance also the guide member has its hone guide portion 315 at an angle to that portion or that end carrying the wing portion 320. The angle between the wing end and the remainder of the guide portion is such that when the guide member is folded to the surface of the jaw member 310 the main hone guide portion 315 will lie contiguous to and along the surface of the jaw member eventhough the hone guide portion 315 has moved through more than 90° arc about the pivot axis provided by the screw 25 which pivotally secures the wing portion 320 to a raised portion 35 of jaw member 310. In operation the device illustrated and described in connection with FIG. 7 is used the same way as that of the preferred embodiment.

What is claimed:

1. In a blade honing device having elongated jaw members with one end thereof cooperatively adapted to grip a blade having an edge to be honed with the said edge disposed generally transverse to the length of the jaw members, and two hone guide members mounted on one of the jaw members remote from said one end with a selected one of said members guiding a hone in a selected path generally lengthwise of the jaw members and in engagement with a transverse to the edge of a blade being honed, the improvement comprising said guide members being pivotally movable relative to said jaw members between an operative position and a folded position, each said guide member having a hone guide portion and a mounting wing portion extending at right angles to and from said hone guide portion and said guide members being at least similar to each other and the pivot axes being separated from each other a distance greater than one-half the thickness of the guide portion and where the pivot axis of at least one of said guide members being so displaced from said end of said jaw member that said one of said guide members abuts said end of said jaw member when said guide member is in said operative position, and fastening means pivotally fastening each said mounting wing portion to its respective of the opposite sides of said jaw member on respective separate pivot axes perpendicular to the length of said jaw members and remote from said one end thereof, when in said operative position the ends of the guide portions at the wing portions overlap each other at the end of the jaw member remote from the said one end and the hone guide portions extend outwardly from said jaw members in opposite directions therefrom so that the hone may be guided in said preselected path, when in said folded position the guide portion of each guide member lies contiguous to and lengthwise along at least one of said jaw members.

* * * * *